US009958125B2

(12) United States Patent
Bauer et al.

(10) Patent No.: US 9,958,125 B2
(45) Date of Patent: May 1, 2018

(54) LIGHT GUIDING ELEMENT FOR A LASER VEHICLE HEADLIGHT

(71) Applicant: ZIZALA LICHTSYSTEME GMBH, Wieselburg (AT)

(72) Inventors: Friedrich Bauer, Bergland (AT); Andreas Moser, Haag (AT); Johann Altmann, Gmünd (AT); Erich Kaufmann, Linz (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 521 days.

(21) Appl. No.: 14/384,722

(22) PCT Filed: Mar. 4, 2013

(86) PCT No.: PCT/AT2013/050054
§ 371 (c)(1),
(2) Date: Sep. 12, 2014

(87) PCT Pub. No.: WO2013/134805
PCT Pub. Date: Sep. 19, 2013

(65) Prior Publication Data

US 2015/0023037 A1 Jan. 22, 2015

(30) Foreign Application Priority Data

Mar. 12, 2012 (AT) ..... A 50074/2012

(51) Int. Cl.
*F21S 8/10* (2006.01)

(52) U.S. Cl.
CPC ..... *F21S 48/1241* (2013.01); *F21S 48/1145* (2013.01); *F21S 48/1154* (2013.01);
(Continued)

(58) Field of Classification Search
CPC .. G02B 6/0003; G02B 6/0066; G02B 6/0073; G02B 6/0008; F21S 48/2225; F21S 48/1241; F21S 48/1136; F21K 9/61
(Continued)

(56) References Cited

U.S. PATENT DOCUMENTS 5,130,900 A * 7/1992 Makita ..... F21S 48/1388 362/304
8,864,328 B2 * 10/2014 Toyota ..... G02B 6/0008 362/511
(Continued)

FOREIGN PATENT DOCUMENTS

CN 102313168 A 1/2012
GB 2477569 A 8/2011
(Continued)

OTHER PUBLICATIONS

Search Report of PCT/AT2013/050054 dated Jun. 27, 2014.
Search Report of priority application No. A50074/2012.

*Primary Examiner* — Jong-Suk (James) Lee
*Assistant Examiner* — Christopher E Dunay
(74) *Attorney, Agent, or Firm* — Eversheds Sutherland (US) LLP

(57) ABSTRACT

The invention relates to a light guiding element (1) for a laser vehicle headlight (2), wherein the laser vehicle headlight (2) comprises at least one laser light source (3) and at least one luminous element (4) which can be irradiated by the laser light source (3) and can thus be excited to emit visible light, and the light guiding element (1) can substantially be arranged between the laser light source (3) and the luminous element (4), wherein the light guiding element (1) has a light entrance surface (5) and a light exit surface (6), wherein the entrance cross-sectional area of the light entrance surface (5) is greater than the exit cross-sectional area of the light exit surface (6), and the light radiated in
(Continued)

Figure 1:
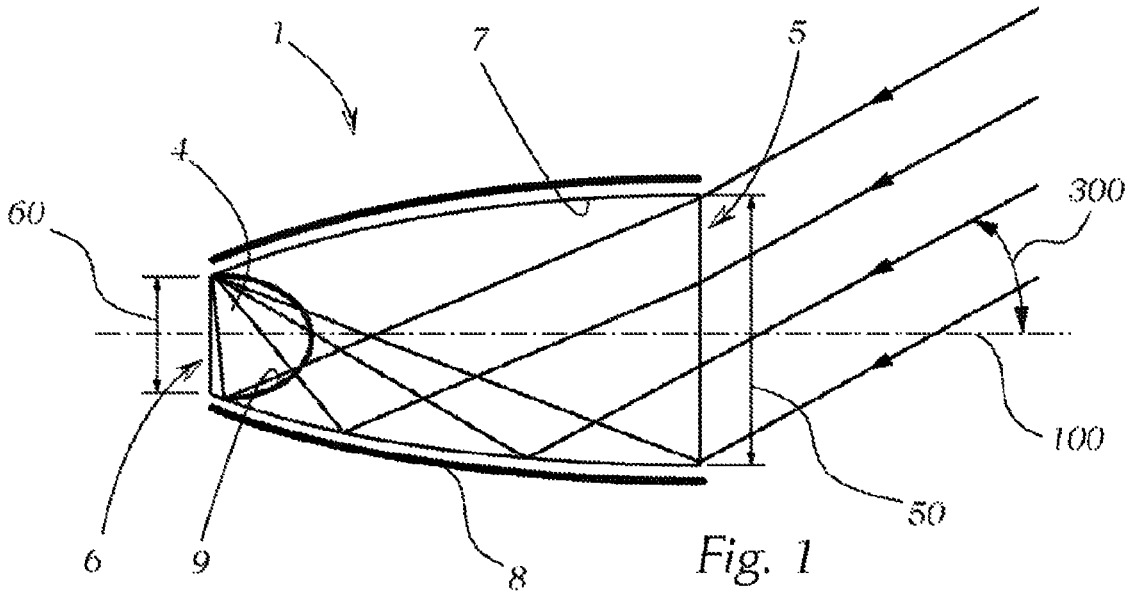

through the light entrance surface (5) can be concentrated in the direction of the light exit surface (6) via the inner surface (7) connecting the light entrance surface (5) and the light exit surface (6). The invention additionally relates to a vehicle headlight (2) comprising at least one light guiding element (1) of this type.

11 Claims, 2 Drawing Sheets

(52) U.S. Cl.
CPC ..... *F21S 48/1159* (2013.01); *F21S 48/14* (2013.01); *F21S 48/325* (2013.01); *F21S 48/34* (2013.01)

(58) Field of Classification Search
USPC ..... 362/539, 259, 555, 510, 511
See application file for complete search history.

(56) References Cited

U.S. PATENT DOCUMENTS 8,911,128 B2 * 12/2014 Takahashi ..... B82Y 20/00 362/259
9,512,972 B2 * 12/2016 Suckling ..... F21S 48/1145
2002/0154859 A1 * 10/2002 Kuroda ..... B82Y 20/00 385/31
2003/0214815 A1 * 11/2003 Ishida ..... F21S 48/1159 362/516
2004/0156209 A1 8/2004 Ishida
2004/0251469 A1 * 12/2004 Yatsuda ..... F21K 9/00 257/100
2005/0057917 A1 * 3/2005 Yatsuda ..... H01L 33/507 362/84
2005/0201114 A1 9/2005 Komatsu
2008/0199143 A1 * 8/2008 Turner ..... G02B 3/0087 385/146
2009/0052189 A1 2/2009 Kon
2010/0232173 A1 * 9/2010 Ohno ..... F21S 2/005 362/538
2011/0148280 A1 * 6/2011 Kishimoto ..... F21S 48/1154 313/483
2011/0194302 A1 * 8/2011 Kishimoto ..... F21S 48/1154 362/511
2011/0280032 A1 * 11/2011 Kishimoto ..... F21S 48/115 362/538
2011/0280039 A1 11/2011 Kishimoto
2011/0292636 A1 12/2011 Fukai et al.
2012/0026721 A1 * 2/2012 Kurt ..... F21S 48/115 362/84
2013/0027964 A1 * 1/2013 Toyota ..... G02B 6/0008 362/554
2015/0030591 A1 * 1/2015 Xiang ..... A61K 39/3955 424/133.1

FOREIGN PATENT DOCUMENTS

JP 2004241142 A 8/2004
WO 2009115976 A1 9/2009

* cited by examiner

LIGHT GUIDING ELEMENT FOR A LASER VEHICLE HEADLIGHT

The invention relates to a light guiding element for a laser vehicle headlight, wherein the laser vehicle headlight comprises at least one laser light source and at least one luminous element which can be irradiated by the laser light source and can thus be excited to emit visible light, and the light guiding element can substantially be arranged between the laser light source and the luminous element. The invention further relates to a vehicle headlight comprising at least one laser light source and at least one luminous element which can be irradiated by the laser light source and can thus be excited to emit visible light.

Various types of vehicle headlights are known in the prior art, wherein headlights with discharge lamps and halogen light sources have been used predominantly in recent years. For energy-saving reasons and in order to further reduce the special requirement of vehicle headlights, the use of laser light sources as semiconductor lasers has been increasingly tested, since these are advantageous in this respect. In order to make the laser light usable for a vehicle headlight, a luminous element, or what is known as a phosphor converter (for example a phosphorous compound, a YAG crystal with cerium doping, etc.) is irradiated using a laser light source and is thus excited to radiate visible light. The phosphor converter thus converts laser light into light of other wavelengths.

Free-beam concepts are also often used here, in which the laser light source is distanced from the luminous element and the laser light travels over a free distance before impinging on the luminous element. In such a case, it is necessary for the laser light to impinge precisely on the luminous element—on the one hand in order to utilise the radiated power to the best possible extent and on the other hand for safety reasons. The used laser light sources emit powers of currently up to 3 W and more, and, in the case of a normal function (for example if the luminous element is not contacted optionally), high-intensity laser light radiation that is harmful to the eyes may lead to injuries, but in any case to the endangerment of other road users.

The object of the invention is therefore to provide a solution for laser vehicle headlights that overcomes the above-mentioned problems of the prior art.

This object is achieved in accordance with the invention with a light guiding element as mentioned in the introduction in that the light guiding element has a light entrance surface and a light exit surface, wherein the entrance cross-sectional area of the light entrance surface is greater than the exit cross-sectional area of the light exit surface, and the light radiated in through the light entrance surface can be concentrated in the direction of the light exit surface via the inner surface connecting the light entrance surface and the light exit surface.

The invention allows the compensation of positioning errors of the light guiding element or of the luminous element with respect to the laser light source and ensures, even in the case of slight deviations, that the laser light radiated in contacts the luminous element and is not deflected in an uncontrolled manner or, where possible, does not endanger other road users. The light entrance surface facing the laser light source in the mounted state is larger than the light exit surface and thus concentrates the incoming radiation, which is deflected by the reflective inner surface toward the luminous element.

Thanks to the solution according to the invention, both the high demands on the mounting of the luminous element relative to the laser light source can be reduced and therefore satisfied and the dimensional stability of the parts used in a laser vehicle headlight can also be ensured during use (for example vibrating load, resonance, strength, thermal expansion, etc.).

Here, the term "inner surface" denotes the interior of the lateral surface (or the lateral surface oriented in the direction of the light guiding element interior) between the light entrance surface and light exit surface. By way of example, the light guiding element has a substantially circular cross section, that is to say the light entrance surface thus has a greater diameter than the light exit surface. The light guiding element preferably consists of a transparent material, such as glass or plastic—the light guiding element is formed for example in one piece as a solid body, that is to say consists continuously of one material. However, it can also be formed as a hollow body. The reflective inner surface is provided in particular due to the total reflection at the interface between the light guiding element and the surrounding environment.

In a variant of the invention, the angle of acceptance of the light guiding element is between 0° and 45° with respect to the optical axis of the light guiding element. This means that the light guiding element is designed to reflect or to concentrate in the direction of the light exit surface any light that impinges on the light entrance surface at an angle between 0° and 45° with respect to the optical axis. The light guiding element according to the invention thus allows high tolerances in terms of the positioning of the laser light source and of the luminous element relative to one another.

The reflective inner surface of the light guiding element is formed substantially as a paraboloid or as a free-form face. The embodiment as a paraboloid can also be implemented in particular in the form of a paraboloid of revolution. Depending on the exact application, the inner surface is thus formed with the desired reflection properties.

In particular with the use of the light guiding element in a vehicle headlight, it is advantageous if there is absolutely no emission of undesirable stray light, which could then falsify the light exposure. To this end, the outer face of the light guiding element, in the region between the light entrance surface and the light exit surface, is favourably provided at least in regions, but particularly completely with a light-impermeable coating. It is thus possible to prevent light away from the light exit surface from being emitted from the light guiding element. The coating can be applied by way of example by painting or vapour deposition.

In a variant of the invention, at least one receptacle for the luminous element is provided in the region of the light exit surface, wherein the receptacle is formed in particular as a blind bore or as a cavity completely surrounded by the light guiding element. The luminous element can thus be arranged in the light guiding element. This has the advantage that, during mounting, only the light guiding element has to be mounted exactly with respect to the laser light source—the optimal position of the luminous element is thus simultaneously ensured, since the luminous element is held in the light guiding element. With the embodiment of the receptacle as a blind bore, the luminous element can be exchanged as required and the light guiding element can continue to be used. With the embodiment as a completely surrounded cavity, the luminous element can be protected against ambient influences. Due to the provision of the receptacle, the luminous element is arranged in the mounted state "below" the light exit surface in the light guiding element.

Various light functions can also be provided with the solution according to the invention. By way of example, in one variant the light exit surface is covered at least in part by a light-impermeable delimitation element. This light-impermeable delimitation element can be formed for example as a coating in the form of a painted coating or a coating applied by vapour deposition, however a separate component can also be glued on or applied otherwise. A dipped beam with clear light/dark transition can be produced by this delimitation element (possibly in conjunction with a free-form reflector face—see below).

In accordance with a further variant of the invention, at least one reflector element running around the light guiding element is arranged between the light entrance surface and the light exit surface, preferably in the region of the light exit surface, in order to deflect the light emitted by the luminous element in a direction facing away from the luminous element. The light emitted by the luminous element can be utilised photometrically by means of this reflector element—for example in conjunction with the above-mentioned delimitation element for providing a dipped beam. In principle, such a reflector element is favourable, for example because the light emitted by the luminous element can be guided optimally into a main reflector of the vehicle headlight with use of the light guiding element in a vehicle headlight. At the same time, an uncontrolled exit of the light from the headlight is prevented and an improved utilisation of the light emitted by the luminous element is possible.

The object of the invention is further achieved in accordance with the invention by a vehicle headlight as mentioned in the introduction in that at least one light guiding element as described above is arranged between the laser light source and the luminous element. The laser light source is favourably arranged in front of the luminous element as viewed in the main radiation direction of the vehicle headlight, such that the light of the laser light source is emitted against the main radiation direction of the vehicle headlight. In this variant, the endangerment of uninvolved road users in particular is prevented by the laser beam in the event of a malfunction of the headlight—since the laser beam runs against the main radiation direction, it cannot radiate in an uncontrolled manner from the headlight. The invention allows the provision of a vehicle headlight that can meet the legal requirements, such as ECE, SAE, CCC, etc.

As an additional safety element, at least one screen element is provided in accordance with a variant of the invention, by means of which light reflected by the light entrance surface of the light guiding element or from the interior of the light guiding element in the main radiation direction of the vehicle headlight can be shielded. In a further variant of the invention, the screen element is formed as a connection piece running between the laser light source and the light guiding element and is formed in particular in a tubular or semi-tubular manner.

The radiation in particular of laser light in a direction outside the vehicle headlight can be prevented with the screen element. To this end, the screen element for example may be coated in a non-reflective or absorbing manner, or may surround the relevant region of the light guiding element.

Figure 2:
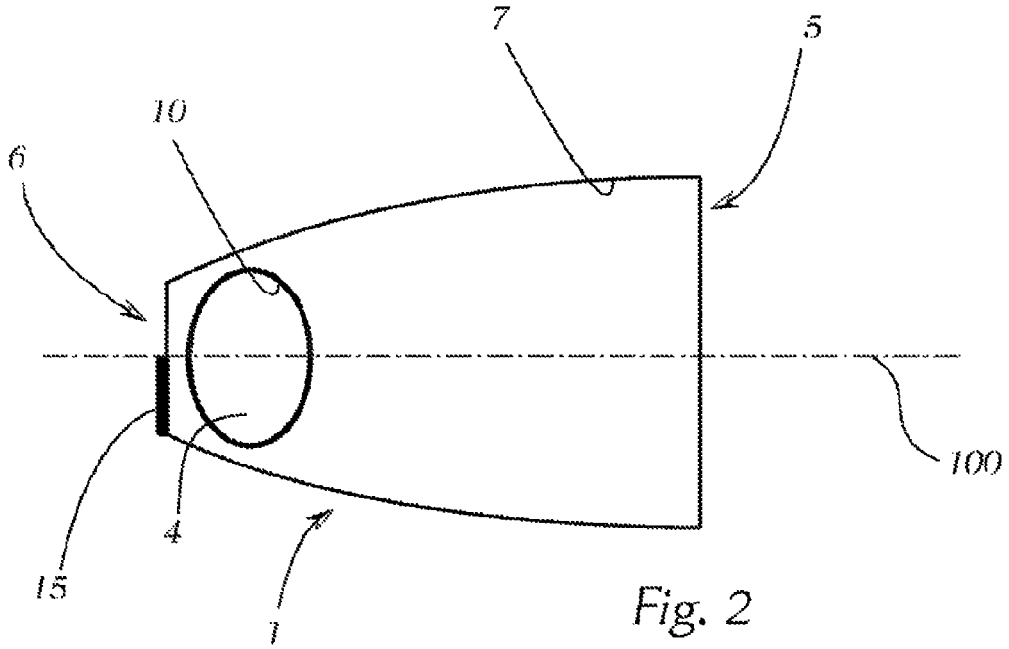
Figure 3:
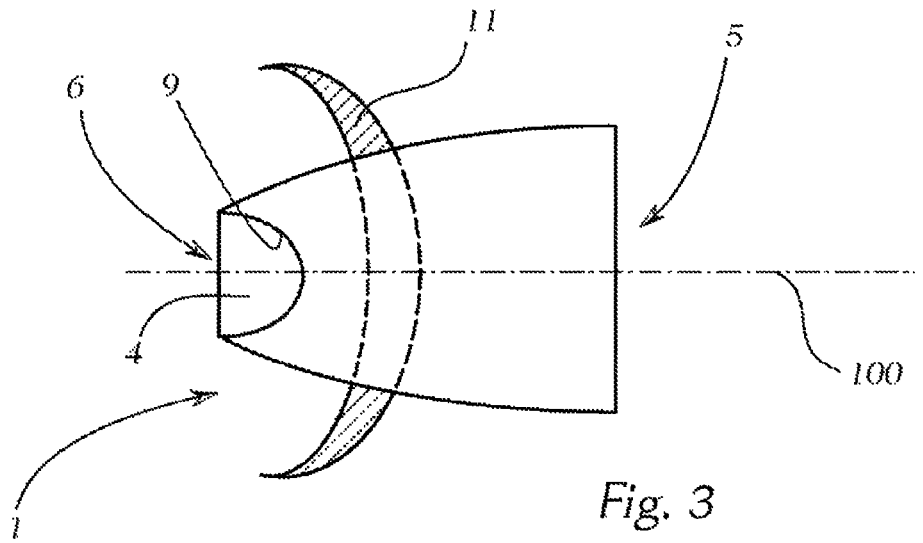
Figure 4:
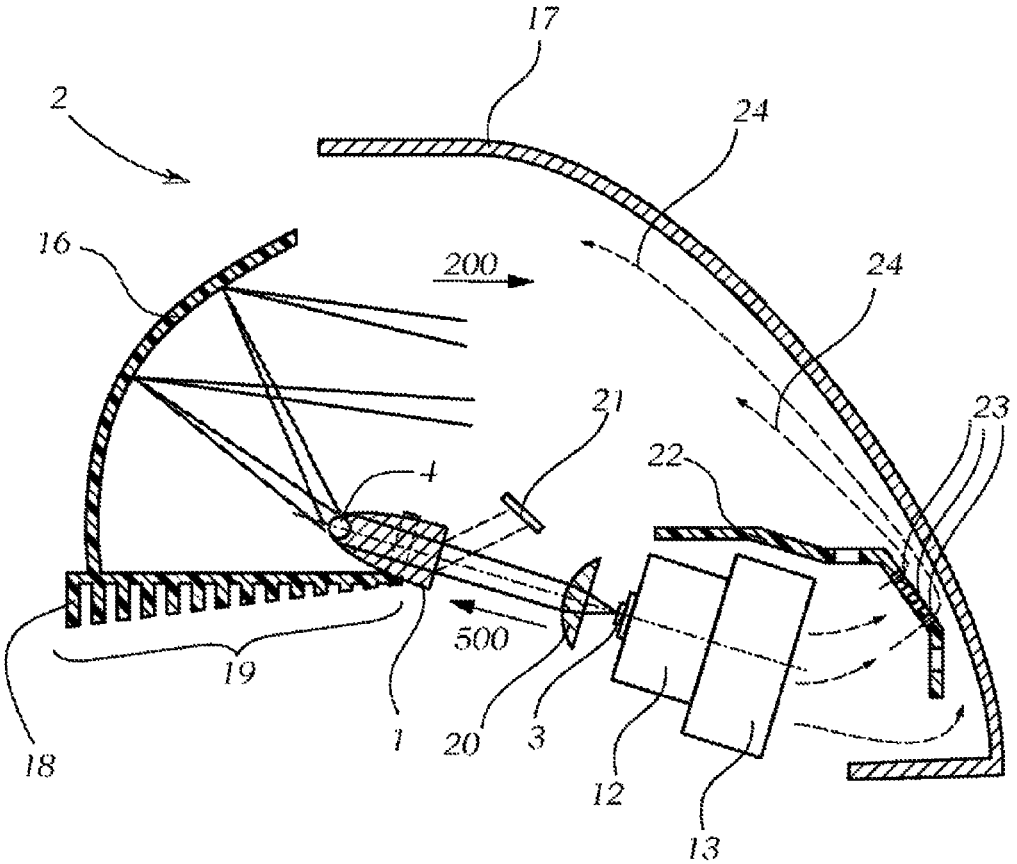

The invention will be explained in greater detail hereinafter on the basis of a non-limiting exemplary embodiment illustrated in the drawing, in which:

FIG. 1 schematically shows a cross-sectional view of a first variant of the light guiding element according to the invention;

FIG. 2 schematically shows a cross-sectional view of a second variant of the light guiding element according to the invention; and FIG. 3 schematically shows a third variant of the light guiding element according to the invention; and FIG. 4 schematically shows a cross-sectional view of a vehicle headlight with a light guiding element according to the invention.

In the following figures like elements are denoted in each case by like reference signs for reasons of clarity.

A first variant of the light guiding element 1 according to the invention is illustrated in FIG. 1. The light guiding element 1 is used for example in a laser vehicle headlight 2 (see FIG. 4), more specifically between a laser light source 3 and a luminous element 4, which is excited by the light radiating from the laser light source 3 to emit visible light, in particular of white colour.

The light guiding element 1 has a light entrance surface 5 and a light exit surface 6. The entrance cross-sectional area of the light entrance surface 5 is greater here than the exit cross-sectional area of the light exits surface 6—for example when, in the present exemplary embodiment, the light guiding element 1 has a substantially circular cross section, the entrance surface radius 50 is thus greater than the exit surface radius 60.

Light that is radiated in (for example by the laser light source 3) is concentrated toward the light exit surface 6 via the inner surface 7 running between the entrance surface 5 and the exit surface 6. This is performed predominantly by total reflection at the interface between the light guiding element 1 and the surrounding medium, which is predominantly ambient air. The luminous element 4 is then located in the region of the light exit surface 6 (see FIG. 4) and is excited by the concentrated laser light to emit visible, preferably white light.

The incident light therefore does not have to impinge here on the light entrance surface 5 perpendicularly, but can strike within an angle of acceptance 300. Here, the angle of acceptance 300 denotes the angle to the optical axis 100 of the light guiding element 1. An angle of acceptance of 0° is given when the light is incident exactly parallel to the optical axis 100 (and therefore perpendicularly to the light entrance surface 5). The angle of acceptance 300 is between 0° and 45° in the present exemplary embodiment.

Light that is incident at this angle of acceptance (that is to say between 0° and 45°) is concentrated toward the light exit surface 6. Light that is incident at an angle greater than the angle of acceptance is reflected either directly on the light entrance surface 5 or is indeed incident into the light guiding element 1, but is then reflected there to and fro such that it again exits at the light entrance surface 5 and does not reach the light exit surface 6.

The light guiding element 1 thus increases the tolerances with which the light of the laser light source 3 (see FIG. 4) radiates onto the luminous element 4 and thus on the one hand facilitates the construction of a laser vehicle headlight 2 and on the other hand places less importance on the jolting occurring during operation.

In order to achieve the concentrating effect accordingly, the inner surface 7 of the light guiding element 1 is formed substantially as a paraboloid or as a free-form face. Furthermore, as illustrated in FIG. 1, the outer face of the light guiding element 1, in the region between the light entrance surface 5 and the light exit surface 6, can be provided with a light-impermeable and/or reflective coating 8. This coating 8 can cover the specified region in regions or also completely.

On the one hand the reflective or concentrating effect of the inner surface 7 is thus increased, and on the other hand no stray light from the light guiding element can occur, which could lead to injuries among uninvolved road users. The coating 8 is formed for example as a painted coating, a coating applied by vapour deposition, or as a form-fitting sleeve.

In principle, the light guiding element 1 may be tubular, that is to say hollow, however it may also be manufactured as a one-piece solid body. Various transparent materials can be used, such as glass, plastic, etc.

A receptacle for a luminous element 4 is provided in the region of the light exit surface. In the illustrated exemplary embodiments just one receptacle for a luminous element 4 is provided, however receptacles for a number of luminous elements 4 may also be provided, or a number of luminous elements 4 can be introduced into one receptacle. In FIG. 1 the receptacle for the luminous element 4 is formed as a blind bore 9, whereas the variant in FIG. 2 provides a cavity 10 completely surrounded by the light guiding element.

The luminous element 4 is contacted by the concentrated laser light and is excited to emit visible light. This visible light then exits from the light guiding element 1 and can be re-used photometrically, for example in a laser vehicle headlight 2, as illustrated and explained in greater detail in FIG. 4.

A variant of the invention can also be seen in FIG. 2, in which the light exit surface 6 is covered at least in part by a light-impermeable delimitation element 15. In the illustrated exemplary embodiment, the delimitation element 15 is arranged beneath a horizontal plane running through the optical axis 100 (the horizontal plane runs perpendicularly to the drawing plane in FIG. 2 and therefore coincides with the dot-and-dash line of the optical axis 100). Of course, other embodiments are also possible depending on the desired light function.

The delimitation element 15 can be formed arbitrarily, for example as a light-impermeable coating of as a separate screen, which is glued onto or applied otherwise to the light guiding element 1 or is mechanically held thereon. The delimitation element 15 allows the generation of a light/dark transition, whereby various light functions, such as dipped beam, fog light, etc., can be provided.

The aforementioned light/dark boundary can be further promoted by the variant illustrated in FIG. 3 of the light guiding element 1 according to the invention: In this figure, the light guiding element 1 has a reflector element 11, which runs around the light guiding element 1 and which deflects the light emitted by the luminous element 4 in a direction facing away from the light entrance surface 5. The light of the luminous element 4 emitted on all sides can thus be utilised photometrically to an even greater extent. The reflector element 11 is formed for example as a half-shell (only the upper or lower half is provided) or as a full reflector.

The reflector element 11 is formed either in one piece with the light guiding element 1 or is formed as a separate component. In the second case, it consists for example of metal, plastic or glass, wherein the side facing the luminous element 4 is reflective, that is to say is coated accordingly. When the reflector element 11 is formed in one piece with the light guiding element 1, it must be ensured that no light can exit in the direction of the light entrance surface 5—the reflective layer is thus to be formed thick enough or a light-impermeable layer is to be applied on the side facing away from the luminous element.

In principle, the reflector element 11 is to be arranged between the light entrance surface 5 and the light exit surface 6, but is preferably located in the region of the light exit surface 6, as in the present exemplary embodiment.

FIG. 4, in a partial illustration in cross section, shows a vehicle headlight 2 in which a light guiding element 1 according to the invention is used. Only the features essential for the understanding of the invention are illustrated, since the other elements of a vehicle headlight are known to a person skilled in the art.

The vehicle headlight 2 comprises a laser light source 3, which for example radiates in a wavelength range between 200 nm and 450 nm, that is to say partly in the non-visible UV range. The radiated power of the laser light source 3 is between 0.5 and 2 W, but may also be higher. By way of example, the laser light source 3 is a semiconductor laser in the form of a laser diode. A number of laser light sources 3 may also be provided, for example in the form of laser diode arrays.

In order to dissipate heat produced during operation, the laser light source 3 in the illustrated exemplary embodiment comprises a heat sink 12 and a ventilation device 13—the ventilation device 13 is used here to supply cool air to the heat sink 12 and to remove heated air. The ventilation device 13 for example may comprise a fan device. The heat sink 12 can be manufactured from a suitable material and may additionally comprise cooling ribs inter alia for example.

Besides the laser light source 3 (illustrated in FIG. 4 with heat sink 12 and fan 13), a luminous element 4 is also provided, which in the present exemplary embodiment is spherical. The spherical embodiment is just one of a number of possible embodiments, that is to say the luminous element 4 can also be formed differently. The luminous element 4 is preferably a phosphor converter, which can be excited by the light of the laser light source 3 in a known manner to emit visible light. In principle, all materials that convert monochromatic laser light into light of other wavelengths (preferably white light) can be used as a phosphor converter. In principle, the phosphor converter is thus a light converter—the electrons of the converter material are excited by the laser light into higher energy levels and, when they drop back, emit light of the wavelength corresponding to the level difference.

The luminous element 4 is arranged in a light guiding element 1 according to the invention, which is positioned in a reflector 16. The reflector 16 guides the light radiated by the luminous element 4 in the main radiation direction 200 of the vehicle headlight 2. The main radiation direction 200 runs from left to right in the present example in FIG. 4. The reflector 16 can be arranged so as to be pivotable and/or adjustable, which is not illustrated in the figures for reasons of clarity. In principle, any embodiments of the reflector 16 are possible, and free-form variants, such as parabolas, hyperbolas, ellipses or combinations thereof, can be used as a reflector surface. The reflector 16 is illustrated in cross section in FIG. 4 and can be formed as a half-shell (only the upper or lower part is provided) or as a full reflector, wherein a series of variants for the reflector 16 are known to a person skilled in the art.

In the illustrated variant of the invention, the luminous element 4 is arranged on the optical axis 400 of the vehicle headlight 2 in a focal point of the reflector 16. It should be noted that the reflector 16 can also be formed as a free-surface reflector with a number of different focal points, wherein the luminous element 4 is arranged level in one of these focal points in accordance with the illustrated exemplary embodiment. Of course, it is not absolutely necessary for the luminous element 4 to be arranged in a focal point—it must, however, remain stationary in the reflector in order to achieve a desired light distribution, which is also to be ensured in the event of jolting. The vehicle headlight 2 is closed by a cover panel 17. The cover panel 17 can be formed arbitrarily, but is preferably largely transparent.

The desired light exposure of the vehicle headlight 2 is produced by the light guiding element 1, the luminous element 4 arranged therein and the reflector 16. In addition, the light guiding element 1 according to the invention enables greater tolerances with respect to the relative positioning between the laser light source 3 and luminous element 4, for example when the light source 3 is exchanged due to repair or when the laser light source 3 is no longer located in the optimal position due to jolting during operation.

In order to fasten the light guiding element 1 in the reflector 16, a carrier element 18 is provided—the carrier element 18 is provided here with cooling ribs 19, which are used to dissipate the heat produced with the light generation in the luminous element 4 and the light guiding element 1. The cooling ribs 19 are merely an example for heat dissipation elements that can be used here—a range of possibilities are known in this respect to a person skilled in the art and therefore will not be discussed here in greater detail.

The laser light source 3 and the luminous element 4 are arranged such that the light of the laser light source 3 is emitted against the main radiation direction 200 of the vehicle headlight 2. The laser light source 3 is thus arranged in front of the luminous element 4 as viewed in the main radiation direction 200 of the vehicle headlight 2, such that the light of the laser light source 3 is emitted against the main radiation direction 200 of the vehicle headlight 2. The radiation direction 500 of the laser light source 3 thus runs opposite the main radiation direction 200 of the vehicle headlight 2. In the case of damage to the vehicle headlight 2 or a malfunction, the light of the laser light source 3 is thus prevented from escaping and potentially endangering other road users.

The radiation direction 500 of the laser light source 3 preferably runs at an acute angle to the main radiation direction 200 of the vehicle headlight 2. The angle may thus be between 0° and 90°. An angle of 0° thus means that the laser light source 3 is arranged after the luminous element 4 as viewed in the main radiation direction 200 over the optical axis of the vehicle headlight 2. Accordingly, an angle of 90° means that the radiation direction 500 of the laser light source 3 runs normal to the optical axis of the vehicle headlight 2. The optical axis and main radiation direction 200 of the vehicle headlight 2 run substantially parallel to one another. Depending on the available installation space for the vehicle headlight 2 or desired field of use, the light source 3 and light guiding element 1 or luminous element 4 can thus be arranged relative to one another.

A series of elements can be arranged between the laser light source 3 and the light guiding element 1 with the luminous element 4. By way of example, an optical element in the form of a converging lens element 20 is arranged immediately after the laser light source 3 in the illustrated exemplary embodiment according to FIG. 4. This converging lens concentrates the light of the laser light source 3 in the direction of the light guiding element 1 or of the luminous element 4 arranged therein. Of course, any other optical elements can also be used, for example lenses and/or prisms of a wide range of different types.

Absorbing elements are favourably arranged around such optical or light guiding elements 1 in order to prevent any reflections of the incoming laser light in the main radiation direction 200 of the vehicle headlight 2 and thus endangerment of other road users. The screen element 21 in FIG. 4 constitutes an embodiment of such elements. Such a screen element prevents a radiation of reflections from the vehicle headlight 2. In a variant or additionally, said optical or light guiding elements 1 and absorbing elements, such as the screen element 21, can also be provided with non-reflecting surfaces or can be formed such that they only reflect or absorb light in the wavelength range of the laser light, but are transparent for visible light and therefore make the headlight components visible. Irregularities, such as inclusions or micro-structures can also be provided here and deflect the laser light, make it visible from outside and allow it to serve as a design element.

By way of example, the screen element 21 in FIG. 4 is arranged above a horizontal plane running through the optical axis 400 of the vehicle headlight 2 between the light guiding element 1 and the cover panel 17. However, other solutions known to a person skilled in the art are of course also possible—the only requirement of such devices is that the light functions of the vehicle headlight 2 are not adversely influenced.

The screen element 21 can also be formed such that it covers the entire free-jet region of the laser light, for example in the form of a tube or a tube with semi-circular cross section (half-pipe). In a further variant, it may be semi-mirrored and/or illuminated for design reasons using a dedicated light source (for example a blue LED). Such variants are not illustrated in the figures.

The invention according to the above embodiments allows the provision of a vehicle headlight that can meet the legal provisions, such as ECE, SAE, CCC, etc.

In the case of the vehicle headlight 2 according to the variant in FIG. 4, the waste heat produced during operation of the laser light source 3 can additionally be used. In the exemplary embodiment according to FIG. 4, the laser light source 3 is arranged beneath a horizontal plane running through the optical axis 400 of the vehicle headlight 2 in the installed state of the vehicle headlight 2, close to the cover panel 17. In FIG. 4, the horizontal plane runs normal to the drawing plane through the optical axis 400 of the vehicle headlight 2.

The laser light source 3 is arranged so close to the cover panel 17 that the cover panel 17 can be heated by means of the waste heat of the laser light source 3. The waste heat can be used to de-mist and de-ice the cover panel 17. Depending on the used laser light source 3 or depending on the material of the cover panel 17, etc., a decision is to be made as to how close the laser light source 3 must be positioned to the cover panel 17. The ventilation device 13 of the laser light source 3 can be used here in an assisting manner by guidance of the waste heat flow. In accordance with the variant in FIG. 4, the laser light source 3 is positioned below a design screen element 22, which has corresponding design screen openings 23 to allow the passage of the waste heat. These design screen openings 23 may have a nozzle-shaped form in accordance with a variant, such that the airflow 24 caused by the waste heat of the laser light source 3 can be selectively guided. Here, a nozzle-shaped form is to be understood to mean a form that allows the guidance of the airflow passing through the design screen openings 23 in order to perform the above-stated task. The de-misting and de-icing, or quite generally the use of the waste heat of the laser light source 3, can thus be performed more efficiently.

The invention claimed is:

1. A laser vehicle headlight comprising a light guiding element (1) for a laser vehicle headlight (2), wherein the laser vehicle headlight (2) comprises at least one laser light source (3) and at least one luminous element (4) which is configured to be irradiated by the laser light source (3) and thus excited to emit visible light, and the luminous element (4) is arranged in the light guiding element (1), wherein the light guiding element (1) has a light entrance surface (5) and a light exit surface (6), wherein an entrance cross-sectional area of the light entrance surface (5) is greater than an exit cross-sectional area of the light exit surface (6), and light radiated in through the light entrance surface (5) is concentrated in the direction of the light exit surface (6) via an inner surface (7) connecting the light entrance surface (5) and the light exit surface (6), wherein the light exit surface (6) is covered at least in part by a light-impermeable delimitation element (15), which is attached to the light guiding element (1) at the light exit surface (6) after the luminous element (4) relative to a laser light radiation direction of the laser light source (3), wherein the laser light source (3) is arranged in front of the luminous element (4) relative to a main radiation direction (200) of the laser vehicle headlight (2), such that the laser light radiation direction of the laser light source (3) is emitted to the luminous element (4) against the main radiation direction (200) of the laser vehicle headlight (2).

2. The laser vehicle headlight according to claim 1, wherein the light guiding element (1) has an angle of acceptance (300) which is between 0° and 45° with respect to an optical axis (100) of the light guiding element (1).

3. The laser vehicle headlight according to claim 1, wherein the inner surface (7) of the light guiding element (1) is formed substantially as a paraboloid.

4. The laser vehicle headlight according to claim 1, wherein an outer face of the light guiding element (1), in a region between the light entrance surface (5) and the light exit surface (6), is provided at least in regions with a light-impermeable and/or reflective coating (8).

5. The laser vehicle headlight according to claim 4, wherein the region between the light entrance surface and the light exit surface is completely provided with the light-impermeable and/or reflective coating.

6. The laser vehicle headlight according to claim 1, wherein at least one receptacle for the luminous element (4) is provided in the region of the light exit surface (6).

7. The laser vehicle headlight according to claim 6, wherein the receptacle is formed as a blind bore (9) or as a cavity (10) completely surrounded by the light guiding element (1).

8. The laser vehicle headlight according to claim 1, wherein at least one reflector element (11), which runs around the light guiding element (1), is provided between the light entrance surface (5) and the light exit surface (6) in order to deflect the light emitted from the luminous element (4) in a direction facing away from the light entrance surface (5).

9. The laser vehicle headlight according to claim 8, wherein the at least one reflector element (11) is provided in a region of the light exit surface (6).

10. The laser vehicle headlight (2) according to claim 1, wherein at least one screen element (21) is provided, by means of which light reflected by the light entrance surface (5) of the light guiding element (1) or from an interior of the light guiding element (1) in a main radiation direction (200) of the vehicle headlight (2) is shielded.

11. The laser vehicle headlight (2) according to claim 1, wherein a screen element (21) is formed as a connection piece running between the laser light source (3) and the light guiding element (1).

* * * * *